US011866853B2

(12) United States Patent
Meier et al.

(10) Patent No.: US 11,866,853 B2
(45) Date of Patent: Jan. 9, 2024

(54) SHIELDING DEVICE, SHIELDING PROCESS AND CROSSLAPPER

(71) Applicant: AUTEFA SOLUTIONS GERMANY GMBH, Friedberg (DE)

(72) Inventors: Andreas Meier, Affing (DE); Eberhard Häberle, Wildberg (DE)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 343 days.

(21) Appl. No.: 17/077,083

(22) Filed: Oct. 22, 2020

(65) Prior Publication Data

US 2021/0123164 A1 Apr. 29, 2021

(30) Foreign Application Priority Data

Oct. 23, 2019 (DE) ..... 20 2019 105 883.8

(51) Int. Cl.
*D01G 25/00* (2006.01)
*B65H 20/06* (2006.01)
*D04H 1/70* (2012.01)

(52) U.S. Cl.
CPC ..... *D01G 25/00* (2013.01); *B65H 20/06* (2013.01); *D04H 1/70* (2013.01)

(58) Field of Classification Search
CPC ..... D01G 25/00; D04H 1/72
See application file for complete search history.

(56) References Cited

U.S. PATENT DOCUMENTS 5,285,554 A * 2/1994 Jean ..... D01G 25/00 270/30.13
2008/0235915 A1* 10/2008 Dilo ..... D01G 25/00 19/296
2012/0180264 A1* 7/2012 Dilo ..... D04H 1/74 19/163
2015/0176159 A1* 6/2015 Kuhn ..... D01G 25/00 19/163
2016/0115628 A1* 4/2016 Dilo ..... D01G 25/00 19/163
2017/0088358 A1* 3/2017 Dilo ..... D03D 3/04

FOREIGN PATENT DOCUMENTS

DE 4217285 C1 * 1/1994 ..... B65H 45/103
DE 4217285 C1 1/1994
EP 1136600 A1 * 9/2001 ..... D01G 25/00
EP 3015578 A1 5/2016
EP 3150753 A1 4/2017

* cited by examiner

*Primary Examiner* — Aiying Zhao
(74) *Attorney, Agent, or Firm* — McGlew and Tuttle, P.C.

(57) ABSTRACT

A crosslapper, a process and a formed fabric web shielding device for a cross lapper shield a formed fabric web moved in the crosslapper. The formed fabric web has a bottom side, a top side and side surfaces located at formed fabric longitudinal edges. The crosslapper includes a displaceable main carriage and a crosslapper laying belt feeding the formed fabric web in a web direction to the displaceable main carriage with the formed fabric web bottom side located on the cross lapper laying belt. The shielding device includes a housing configured to be arranged in the crosslapper and configured to cover the side surfaces of the formed fabric web located on the laying belt and being fed to the displaceable main carriage, which side surfaces extend along the web direction, to shield the side surfaces of the formed fabric web against external environmental effects.

18 Claims, 8 Drawing Sheets

46,32
25,26
37
48
5
2
7
10
2
10
4
28
31
47,33
39
21

SHIELDING DEVICE, SHIELDING PROCESS AND CROSSLAPPER

CROSS REFERENCE TO RELATED APPLICATIONS

This application claims the benefit of priority under 35 U.S.C. § 119 of German Application 20 2019 105 883.8, filed Oct. 23, 2019, the entire contents of which are incorporated herein by reference.

TECHNICAL FIELD

The present invention pertains to a shielding device, to a shielding process and to a crosslapper with the shielding device being for a formed fabric web moved in the, wherein the formed fabric web has a bottom side, a top side and side surfaces located at longitudinal edges and is fed in a web direction to an upper displaceable main carriage, with the bottom side located on a laying belt of the crosslapper.

TECHNICAL BACKGROUND

Such a crosslapper with a shielding device is well known from EP 3 015 578 A1 and EP 3 150 753 A1. In this case, the formed fabric web, which is located with its bottom side on a laying belt and is transported to a displaceable upper carriage, is covered over its entire surface on its upper side by an overlying and concurrently driven belt. It is further disclosed to use a plurality of parallel wires or belts instead of the cover belt for covering the formed fabric web upper side in some areas.

DE 42 17 285 C1 pertains to the release of a formed fabric from the lower laying carriage onto the discharge belt of a crosslapper with compensation of an angle error, wherein the laid nonwoven is covered by an additional cover belt and protective plates that are carried along at the laying carriage are arranged between the laying carriage and the cover belt.

SUMMARY

An object of the present invention is to provide improved shielding technology.

The shielding technology of the present invention, i.e., a shielding device, a crosslapper equipped with the shielding device and the shielding process, has a variety of advantages.

The shielding device is an object which can be manufactured and marketed independently. It can be installed during the manufacture of a crosslapper. However, it may also be used to retrofit an existing crosslapper. It is correspondingly configured and prepared for this purpose.

The shielding technology of the invention makes it possible with a housing to cover and to protect the side surfaces of the formed fabric web located on the laying belt and extending along the web direction. The formed fabric web has a bottom side, with which it is located on the laying belt, a top side and side surfaces located at the longitudinal edges and located opposite one another. The bottom side and the top side have a width dimension that is greater than the height dimension of the side surfaces located at the edge.

The housing provides a covering that has the function of shielding these side surfaces of the formed fabric web against external environmental effects, especially air flows, namely by defining an air flow barrier adjacent to the formed fabric web side surfaces located at formed fabric longitudinal edges. An embodiment of the shielding technology, in which the housing covers and shields the formed fabric web located on the laying belt in at least some areas on all its free surfaces, is especially advantageous.

As a result, it is possible to transport the formed fabric web transported on the running laying belt in a shielding channel, which is closed at least laterally by the housing and on the bottom side by the laying belt. Air flows, especially air swirls, can be kept away from the running formed fabric web such that they do not have an adverse effect on the formed fabric web. Lateral pressing in or folding over of the lateral longitudinal edges of the formed fabric web and possibly also temporary raising of parts of the formed fabric web towards the laying belt can especially be prevented by the shielding technology. Undesirable fading and consequently structural changes in the formed fabric web may also be avoided. A U-shaped shielding channel, which is formed by the housing and the laying belt and is open upwards in at least some areas, can be sufficient for this. In a preferred embodiment, the shielding channel is also closed on the top side and thus circumferentially in at least some areas in the circumferential direction.

The housing may cover said formed fabric web at a distance at least on one side. This distance may be, e.g., between the top side of the formed fabric web and the top area of the housing. As a result, a slow-flow open space or air space may be formed over the formed fabric web. The covering may likewise be located at a distance on the side surfaces of the formed fabric web. This lateral distance may be shorter than the distance upwards.

The housing can be mounted or is mounted, e.g., in a stationary manner in the crosslapper. It may have a rigid configuration. The housing may be arranged above the one main carriage, especially upper main carriage or upper carriage.

Due to a covering located at a distance, the formed fabric web transported on the laying belt does not come into physical contact with the housing. An adverse effect on the formed fabric web due to such a physical contact can be avoided. However, the housing may mesh with the running laying belt in a preferably sealing manner in order to form, as a result, said shielding channel which covers in a sealing manner. The housing and the formed shielding channel may be open on the end faces or may be closed, as needed, in at least some areas.

The housing has a wall which is impervious to external environmental effects, especially air flows. In one advantageous embodiment, the housing has a hood-like shape and overlaps the laying belt in at least some areas and the formed fabric web located on it. In this case, the wall is correspondingly configured with side wall areas and top areas. In another embodiment, the wall may have only lateral wall areas and be open upwards. On the other hand, the housing may adjoin the laying belt closely, wherein an admission of external environmental effects, especially air flows, to the housed formed fabric web can likewise be prevented.

The mentioned direction references top, bottom and lateral refer to the position of the formed fabric web at, especially on, the laying belt. In case of a usual configuration of the crosslapper, the formed fabric web is located with its bottom side on the laying belt. However, other embodiments are also possible.

In the installed situation in the crosslapper, the housing may extend along the laying belt and the formed fabric web in said web direction as well as along a travel path of the one main carriage, especially the upper carriage. Said travel path and the web direction may have the same longitudinal direction component. They may especially be directed in the same direction.

The housing may interact with the laying belt and mesh in a sealing manner with the laying belt, especially with the lateral longitudinal edges thereof. The housing may mesh with the longitudinal edges in a manner overlapping transversely to the web direction and thereby preferably in a sealing manner. The housing may mesh differently with the laying belt over its length or viewed in the web direction.

The housing may be divided into partial areas over its length. It may extend in a first partial area under the laying belt and extend in another partial area above the laying belt. An open slot remains between the overlaps.

Said partial areas may be arranged one behind the other in the web direction and adjoin one another closely. Different wall sections may be formed at the wall, especially at a bottom wall, at the partial areas. At the transition point of the partial areas and the wall sections, a support device, especially a rotatable support roller, may be present for the laying belt with the formed fabric web located on it. This laying belt is also designated as a web-carrying laying belt or infeed belt. The side walls of the partial areas may overlap at the transition point and shield the formed fabric web laterally.

The extending under and extending over in some sections of the housing at the web-carrying laying belt has advantages for the adaptation of the shielding and sealing effect to the travel motions of the one upper main carriage, especially upper carriage. The partial area or wall section with extending under the housing at the laying belt may be located in an area outside of the travel path of said upper main carriage. Said partial area or wall section with the extending over may be located in the travel path area of said main carriage. Due to the extending over, the flexible laying belt with the formed fabric web lying on it can be unrolled downwards or be rolled upwards in case of a travel motion of said main carriage in a rolling motion by the housing. The lateral distance between the formed fabric web and the housing is advantageous for the unrolling and the rolling up and for the collision-free passage of the formed fabric web through the open slot between the overlaps. The shielding function is guaranteed for the formed fabric web being fed up to its entry into said upper main carriage, especially upper carriage, and in the pickup and infeed area thereof.

In the installed situation in the crosslapper, the housing may extend in the length over the area along the web-carrying laying belt that is prone to interference. The housing may extend, e.g., in length especially over the travel path of the main carriage. The housing may extend from an area at the edge of the crosslapper on the feed side and at least largely free from interference, e.g., from an end area of the crosslapper on the feed side, up to said main carriage, especially the upper carriage, and beyond this.

The end area on the feed side may be arranged at the end face of the crosslapper and may be the inlet area of the formed fabric web in the crosslapper. The housing may end at this end area on the feed side.

The housing may extend in the installed situation up to said upper main carriage, especially upper carriage, when this main carriage is located in an end position of its travel path, which is located the farthest from said end area on the feed side. At this remote end position, the housing can extend above said main carriage and end at the rear edge area thereof or behind it. In this case, the housing overlaps the point of entry of the formed fabric web into said upper main carriage, especially upper carriage. The housing extends beyond said main carriage in the other travel path positions between said end positions as well.

The housing may have a linear extension. It may have the mentioned open end faces. In addition, it may have a box-like (box-shape) configuration and have essentially a C-shape in its cross section with said slot. The cross-sectional shape may be prismatic or rounded. The housing and its wall have side walls which extend along the travel direction and possibly a top wall adjoining same closely as well as a bottom wall adjoining each of the side walls, which bottom wall laterally overlaps the laying belt, especially the longitudinal edges thereof. The bottom wall may have the mentioned wall sections extending under and extending over. It may have the mentioned slot-like opening corresponding to the C-shape in the middle area.

The housing may be configured as adjustable in its dimensions. In one advantageous embodiment, the housing is adjustable in its height. In particular, the wall sections formed at the bottom wall and extending under and extending above the laying belt in some sections can be adjusted in its height position and be adapted to the laying belt. They may have a sealing coating at the area of contact with the laying belt, especially with the respective longitudinal edge thereof.

The crosslapper is configured as a crosslayer in one advantageous embodiment. As an alternative, it may be configured in a different manner, e.g., as a longitudinal layer or the like. The crosslapper has a plurality of, e.g., two main carriages. This may be an upper main carriage, which is also designated as upper carriage. On the other hand, a lower main carriage may be present, which is also designated as laying carriage. The upper main carriage may be the first main carriage in the web direction or feed direction of the formed fabric web. However, there may also be other main carriage configurations.

The crosslapper may have one or more laying belts, at least one of which is guided over said one and especially upper main carriage or upper carriage. The crosslapper may be configured as a so-called belt layer. In one advantageous embodiment, it may have two or more, e.g., three, laying belts. The laying belt or the laying belts may also be guided over one or more other main carriages, especially over the lower main carriage or laying carriage.

Between said main carriages, especially upper carriage and laying carriage, the formed fabric web may be embedded between two laying belts. It may in the process be transported directly by one main carriage to the other main carriage. The crosslapper is configured in this connection as a synchronous layer, in which said main carriages always move in the same direction and with different path lengths as well as travel speeds. As an alternative, the formed fabric web and the laying belts can be guided between said main carriages via a stationary deflection in a machine frame of the crosslapper, in which case a so-called synchronous crosslapper is formed, in which said main carriages move in opposite directions with different path lengths and speeds.

The main carriages are displaceable over a discharge belt of the crosslapper and lay the fed formed fabric web on the discharge belt, wherein a single-layer or multi-layer nonwoven is formed. The housing of the shielding device is arranged at the one belt section of the laying belt leading to the upper main carriage or upper carriage and at the formed fabric web being fed on it.

The web-carrying laying belt may be guided and stretched via deflection devices. The deflection devices may, in particular, be rotatable deflection rollers. The deflection devices are located at an end area on the feed side of the crosslapper and are arranged here, e.g., in a stationary manner. On the other hand, they are located at a said upper main carriage, especially upper carriage.

A rotatable support roller or another support device that is arranged at the transition point between the extending-under and extending-over wall sections may additionally support the stretched laying belt. This support roller or the support device may be located especially close to and outside of said end position of the main carriage travel path, which end position is arranged closest to the end area of the crosslapper on the feed side. The support roller or the support device can support and define the above-mentioned unrolling and rolling-up function of the laying belt on the bottom side of the housing during the travel motion of said main carriage. On the other hand, an additional support function for the widely stretched laying belt may take place when said main carriage is located in the end position that is located the farthest from said end area. The support roller or the support device can be arranged at the shielding device or at the crosslapper.

The crosslapper may have one or more auxiliary carriages, which pull out and support a belt loop at a respective laying belt. These auxiliary carriages, which are displaceable in the web direction, may be coupled with a respective main carriage and may carry out a travel motion as a function of the main carriage motion.

One auxiliary carriage may be arranged and become displaced with a belt loop above the shielding device. A housing with a closed top area and with a shielding channel closed circumferentially in the circumferential direction may in this case protect the moving formed fabric web against disturbing effects of this main carriage, e.g., air swirls. Said auxiliary carriage can be arranged and moved at the crosslapper in an efficient manner in terms of kinematics and installation space, on the other hand. Another auxiliary carriage may be arranged with its belt loop below the shielding device. It may be arranged here between the shielding device and the discharge belt of the crosslapper. The laying belt and the housing closely adjoining same protect the formed fabric web being fed on the laying belt against disturbing effects of this auxiliary carriage and of the belt loop.

The shielding device also has advantages for the embodiment of the crosslapper, especially for the configuration and the arrangement of one or more, e.g., two, auxiliary carriages. These auxiliary carriages may be arranged in an efficient manner in terms of kinematics and installation space in an area above the discharge belt. In this connection, at least one auxiliary belt may be arranged in an area between the upper main carriage and the lower main carriage. This makes possible a compact construction. This embodiment also has advantages over an arrangement of auxiliary carriages under the discharge belt that is known from practice. The design effort with roller arrangements, support devices, clamping devices, etc. can be reduced. The overall height of the crosslapper may be reduced as well. In addition, the crosslapper can be adapted in an efficient manner to system components connected on the feed side and on the discharge side. A system component on the feed side may be, e.g., a formed fabric generator, and in particular a card, an airlay or the like. A system component on the discharge side may be a bonding device, and in particular a needling machine, a hydroentanglement device or the like.

The crosslapper may have a machine frame, a carriage guide and a drive device. The main carriage or main carriages and the possibly present auxiliary carriage or auxiliary carriages may have at least partially a common carriage guide, which reduces the design and space effort and makes possible a compact configuration of the crosslapper. The shielding device is also advantageous for this, since a compact construction could otherwise have especially strong adverse disturbing effects on the formed fabric web being fed. The continuously driven laying belts and the main carriage or main carriages as well as the possibly present auxiliary carriage or auxiliary carriages may have separate drive components of a drive device. The drive components may have a rotating drive motion or a translatory drive motion, e.g., in the form of a linear drive for the main carriages and/or auxiliary carriages. An electric linear motor, which may also have a guide function, can be used for the main carriage or main carriages and possibly the auxiliary carriage or auxiliary carriages.

In one embodiment, the shielding channel formed by the housing and the laying belt may be empty. In another variant, not shown, devices for influencing the formed fabric web running through and/or for influencing the air that is located in the channel interior may be present in the or at the shielding channel. Such devices may be, e.g., retracted, vertical or oblique, bulkhead-like walls or the like. Furthermore, targeted air flows can be directed into the shielding channel and towards the running formed fabric web. These air flows can press, e.g., the formed fabric web against the running laying belt. A stretching effect and/or compression effect may also be exerted with such air flows or the like on the running formed fabric web. This effect may be local. Such devices may be, e.g., baffles, blowing devices, suction devices or the like at the housing.

The shielding process for a formed fabric web moving in a crosslapper, especially in a crosslayer, makes provisions for the formed fabric web to be fed in the web direction on a laying belt of the crosslapper to an upper displaceable main carriage of the crosslapper, especially to an upper carriage, and to be shielded thereby on its path by means of a housing arranged in the crosslapper, which housing covers the side surfaces of the formed fabric web located on the laying belt, which side surfaces extend along the web direction, and shields against external environmental effects, especially against air flows. The formed fabric web located on the laying belt is preferably covered on all its free surfaces and is shielded against external environmental effects, especially air flows.

The housing which preferably has a hood-like configuration and is equipped with a wall impervious to external environmental effects, and especially air flows, can adjoin the laying belt closely. The formed fabric web located on the laying belt is covered at a spaced location at least on one side, especially on the top side.

The housing interacts with the laying belt and meshes with same in a sealing manner. The housing may mesh with the longitudinal edges of the laying belt in a manner overlapping at right angles to the web direction, and preferably in a sealing manner.

The housing, which is divided into a plurality of, especially two, partial areas in the longitudinal direction and the web direction, alternately extends under and extends above the laying belt in a sealing manner, especially the longitudinal edges thereof in the partial areas. An extending under takes place in the first partial area (leading partial area) viewed in the web direction and an extending over takes place in the following partial area. The change from extending under to extending over takes place at a transition point, which is arranged in the area of an end position of the upper main carriage or upper carriage, on the feed side. The partial area with the extending over of the housing is located in the area of the travel path of the upper main carriage or upper carriage.

The shielding device and the shielding process as well as the crosslapper being claimed may have the following configuration features, which can be used alone or in combination.

The housing of the shielding device may be configured and may be able to be arranged or may be arranged in the crosslapper such that the housing covers the formed fabric web located on the laying belt on all its free surfaces and shields against external environmental effects, especially air flows.

The housing of the shielding device may cover the formed fabric web located on the laying belt and being fed to the upper main carriage at a distance at least on one side, especially on the top side.

The housing of the shielding device may have a hood-like shape or a shape that is open at the top in the installed position. The housing may have a wall that is impervious to external environmental effects, especially air flows. The housing, and in particular its wall, may be configured and may be able to be arranged or be arranged in the crosslapper such that it adjoins the laying belt closely.

The housing of the shielding device may be configured and may be able to be arranged or may be arranged in the crosslapper such that it extends along the laying belt and the formed fabric web in the web direction as well as along a travel path of the one main carriage, especially of the upper carriage.

The housing of the shielding device may be configured and may be able to be arranged or may be arranged in the crosslapper such that it interacts with the laying belt and meshes in a sealing manner with the laying belt.

The housing of the shielding device may be configured and may be able to be arranged or may be arranged in the crosslapper such that it meshes with the longitudinal edges of the laying belt in a manner transversely overlapping in the web direction. This meshing may be a sealing meshing.

The housing of the shielding device may be divided in the longitudinal direction into partial areas. In this connection, the housing may be configured and may be able to be arranged or may be arranged in the crosslapper such that it extends in a sealing manner in the one partial area under the laying belt, especially the longitudinal edges thereof, viewed in the web direction, and extends over same in a sealing manner in another partial area. The housing may extend under the laying belt on the bottom side and extend above the laying belt on the top side.

The partial area with the extending under of the housing at the laying belt may be arranged in an area above the travel path of the upper main carriage, especially upper carriage, at a crosslapper.

The partial area with the extending over of the housing at the laying belt may be arranged in the area within the travel path of an upper main carriage, especially upper carriage.

Along said main carriage travel path, the laying belt may be unrolled relatively from the housing or be rolled up at the housing by the upper main carriage, especially upper carriage.

The housing of the shielding device and/or the crosslapper may have at a transition point between the partial areas a support device arranged there, especially a rotatable support roller, for the web-carrying laying belt.

The housing of the shielding device may be configured and may be able to be arranged or may be arranged in the crosslapper such that it is arranged in the crosslapper above the upper main carriage, especially upper carriage.

The housing of the shielding device may be configured and may be able to be arranged or may be arranged in the crosslapper such that it extends in the crosslapper from an end area of the crosslapper on the feed side up to an upper main carriage, especially upper carriage, and possibly beyond this. The housing may extend from the end area of the crosslapper on the feed side up to an end position of the travel path of the upper main carriage. The housing may extend beyond this and over the travel path of the upper main carriage.

The housing of the shielding device may be configured and may be able to be arranged or may be arranged in the crosslapper such that it extends up to an end position of the travel path of an upper main carriage, especially upper carriage, which is located the farthest away from an end area of the crosslapper on the feed side.

The housing of the shielding device may be configured and may be able to be arranged or may be arranged in the crosslapper such that it extends beyond the upper main carriage, especially upper carriage, at an end position of the travel path of an upper main carriage, especially upper carriage, which end position is closest to an end area of the crosslapper on the feed side.

The housing of the shielding device may be configured and may be able to be arranged or may be arranged in the crosslapper such that it extends over a point of entry of the formed fabric web at an upper main carriage, especially upper carriage. On the one hand, the housing may end at an end area of the crosslapper on the feed side and on the other hand, at an end position of the travel path of an upper main carriage, especially upper carriage, which end position is located the farthest away herefrom.

The housing of the shielding device may have a carrying device which is configured for a stationary arrangement of the housing in the crosslapper. The carrying device may have a support frame for the wall of the housing and support arms for fastening the housing in the crosslapper. The carrying device may also have a carrying arm for a support device, especially a support roller, for supporting the laying belt.

The housing of the shielding device may have a linear extension.

The housing of the shielding device may have open end faces.

The housing of the shielding device may have a box-shape configuration and have essentially a C-shape in cross section. The C-shape may be open downwards in the installed position.

The housing of the shielding device may have side walls extending along the web direction. The housing may also have a top wall closely adjoining the side walls. The housing of the shielding device may also have a bottom wall adjoining each of the side walls, which bottom wall laterally overlaps the laying belt, especially the longitudinal edges thereof.

The bottom wall may have a respective wall section extending under the laying belt, especially the longitudinal edges thereof, as well as a respective wall section following in the web direction and extending above the laying belt, especially the longitudinal edges thereof.

The bottom wall may contact the laying belt in a sealing manner in the overlap area. The bottom wall may also have a coating that is a sealing coating and promotes sliding in the overlap area. This applies to the extending-under and extending-over wall sections as well.

The crosslapper, especially crosslayer, being claimed may have one or more auxiliary carriages, which are displaceable and are coupled with a main carriage, especially tensioning carriage for a belt loop of a laying belt. An auxiliary carriage may be arranged and displaceable with a belt loop above and/or below the shielding device.

The crosslapper, especially crosslayer, being claimed may have a machine frame, a carriage guide for the main carriage or the main carriages and possibly one or more auxiliary carriages as well as a drive device for the one or more laying belts and for the main carriage or the main carriages and possibly for the auxiliary carriage or the auxiliary carriages.

The present invention is shown in examples and schematically in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
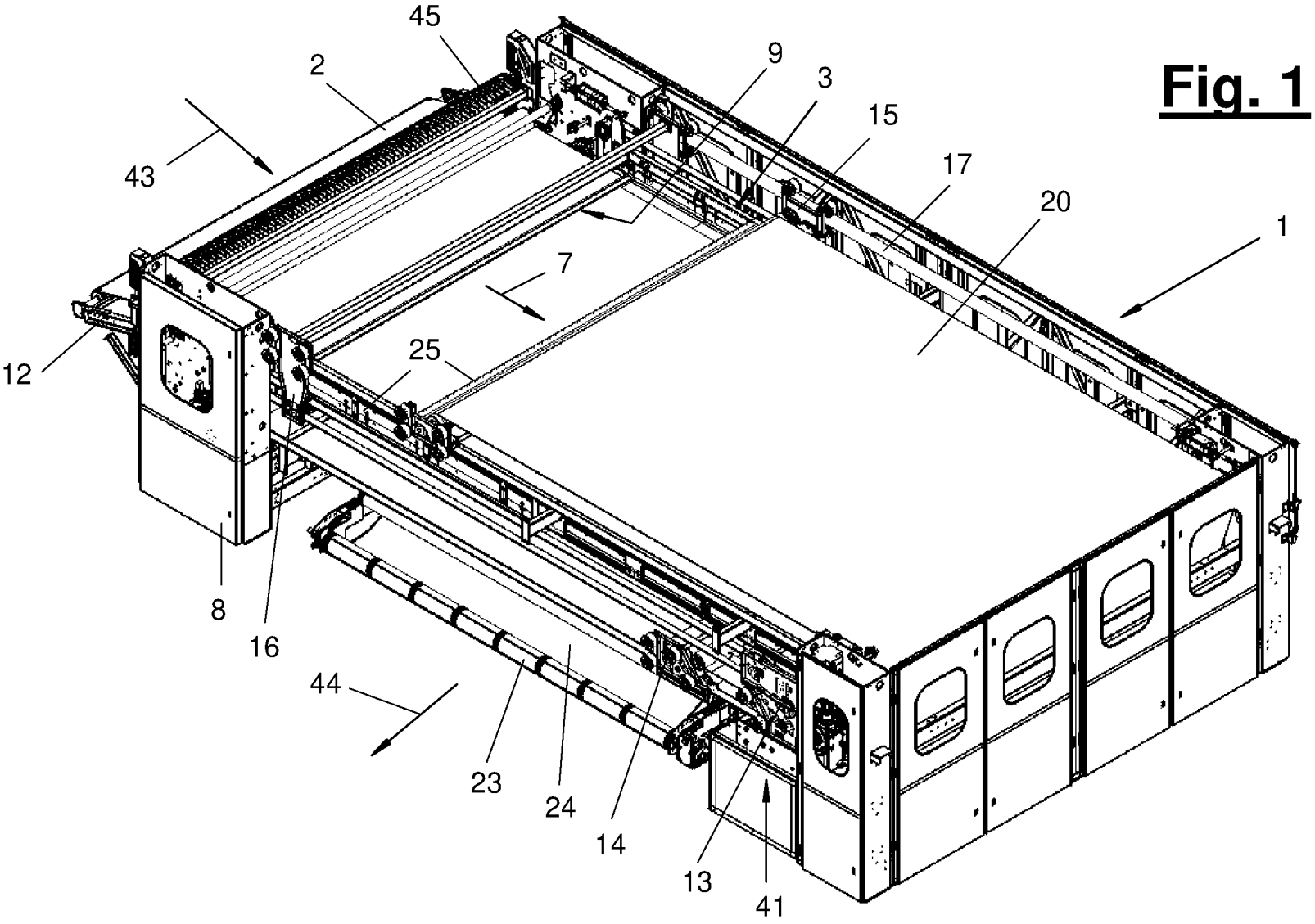
FIG. 1 is a perspective view of a crosslapper with a shielding device.

Referring to the drawings, the present invention pertains to a shielding device (3) for a moving formed fabric web (2) and for installation at a crosslapper (1). The present invention further pertains to a shielding process and to a crosslapper (1) equipped with the shielding device (3).

FIG. 1 shows a crosslapper (1) with a shielding device (3) for a moving formed fabric web (2). The formed fabric web (2) has a, e.g., cotton-like configuration and consists of fibers that are loose and arranged, e.g., in a tangled manner. It is configured as a nonwoven product. The fibers may be synthetic fibers or natural fibers. The formed fabric web (2) has a bottom side (6), a top side (5) and two side surfaces (4).

The formed fabric web (2) is fed in a feed direction (43) from a system component, not shown, e.g., from a formed fabric generator, especially from a card or from an airlay, to the crosslapper (1). The crosslapper (1) may have for this purpose a feed device (12), e.g., a feed belt. In the crosslapper (1), the fed single-layer or multi-layer formed fabric web (2) is laid on a discharge belt (23) to form a single-layer or multi-layer nonwoven (24) and discharged from this discharge belt (23) in the discharge direction (44) to a downstream system component, e.g., to a bonding device, especially a needling machine or a hydroentanglement device.

The crosslapper (1) shown is configured as a crosslayer. It has a machine frame (8) with a lateral cladding that is present in at least some areas. At one end face, the crosslapper (1) has an end area (9) on the feed side. This end area may be configured as an inlet area of the formed fabric web (2) being fed into the crosslapper (1) and the machine frame (8) thereof.

The crosslapper (1) has a plurality of, e.g., two main carriages (13, 14). The main carriages are arranged one above the other. The upper main carriage is designated below as upper carriage (13) and the lower main carriage is designated below as laying carriage (14). The main carriages (13, 14) move back and forth over the circulating discharge belt (23) transversely or obliquely to the discharge direction (44). They are in this case guided by means of a carriage guide (17) in the machine frame (8). The travel motions of the main carriages (13, 14) are directed transversely or obliquely to the direction of motion of the discharge belt (23) and to the discharge direction (44).

In the embodiment being shown, the crosslapper (1) is configured as a synchronous layer, wherein the main carriages (13, 14) always move in the same directions and in this case with different travel path lengths and speeds. The lower main carriage or laying carriage (14) moves back and forth over the width of the discharge belt (23) and in the process lays the fed formed fabric web (2) while forming the nonwoven (24) on the discharge belt (23). The upper main carriage or upper carriage (14) moves over half of the travel path distance of the lower main carriage or laying carriage (14) and moves in the process with half the travel speed.

Figure 4:
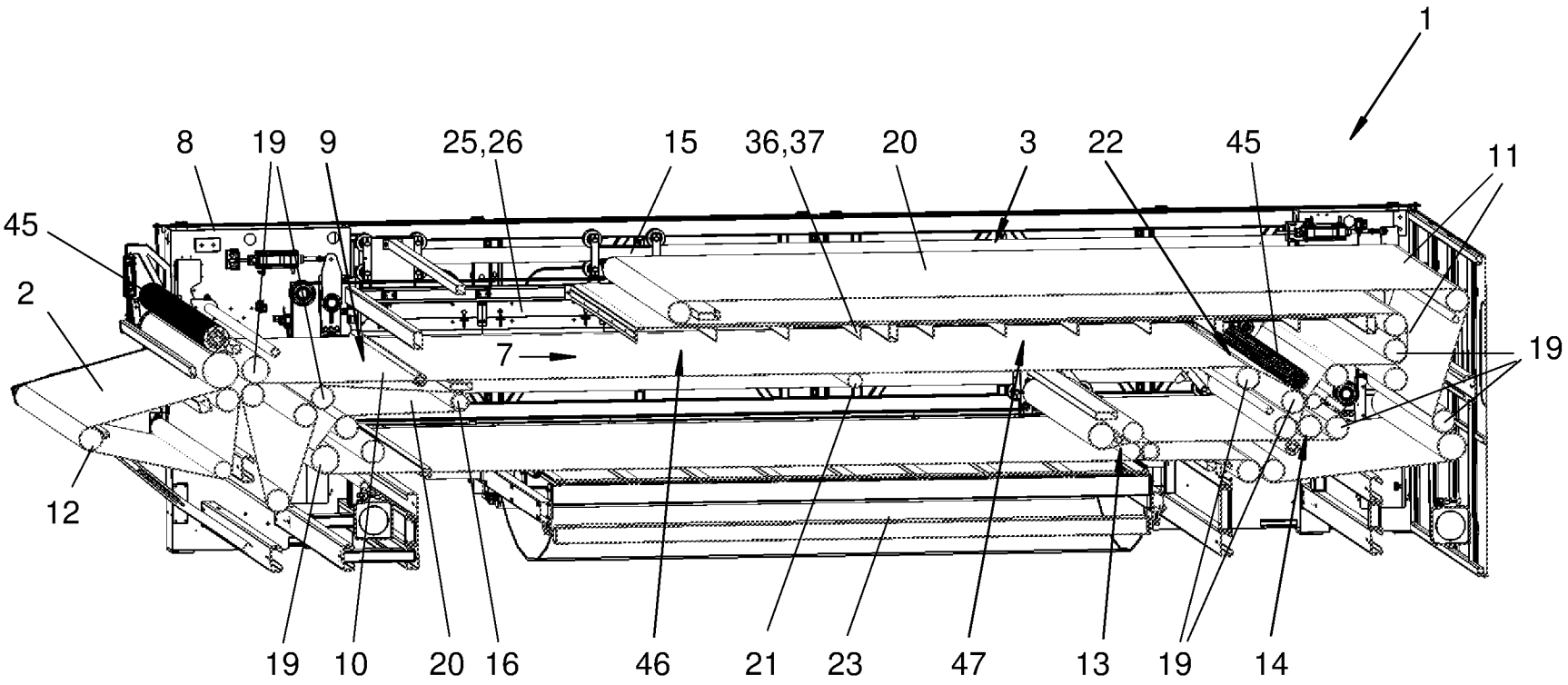
FIG. 4 is a perspective longitudinal sectional view through the crosslapper and the shielding device from FIG. 1.

The crosslapper (1) has one or more endless and continuously driven laying belts (10, 11). In the embodiment shown, two laying belts (10, 11) are present. As an alternative, the number of laying belts may be smaller or larger. The laying belts (10, 11) transport the formed fabric web (2). They are guided over the main carriages (13, 14) by means of deflection devices (19), e.g., rotatable deflection rollers. Such deflection devices (19) for the laying belts (10, 11) are also arranged in the machine frame (8). FIG. 4 shows the laying belt guide.

The one laying belt (10) picks up the fed formed fabric web (2) at the end area (9) and transports it in the web direction (7) to the upper main carriage or upper carriage (13). This laying belt (10) is designated as an infeed belt or as a web-carrying laying belt. The other laying belt (11) forms a counter belt, which is likewise guided over the upper main carriage or upper carriage (13). At the upper main carriage or upper carriage (13), the formed fabric web (2) being fed is deflected in the opposite direction, preferably by 180°, wherein it is then taken up between the laying belts (11, 10) and is transported to the lower main carriage or laying carriage (14).

The upper main carriage or upper carriage (13) has a point of entry (22) for the laying belt (10) or infeed belt and the formed fabric web (2). The counter belt (11) can be fed to the point of entry, which has a, e.g., funnel-like configuration. In the funnel area, a perforated pressing roller (45) may be arranged for pressing, compressing and ventilating the formed fabric web (2). The laying belt (10) and the formed fabric web lying on it are deflected by 180° via a plurality of, e.g., three deflection devices (19) at the main carriage or upper carriage (13).

The crosslapper (1) being shown has, in addition, one or more, e.g., two auxiliary carriages (15, 16), which are displaceable parallel to the main carriages (13, 14) at a preferably common carriage guide (17). The auxiliary carriages (15, 16) are configured, e.g., as tensioning carriages, which pull out each belt loop (20) of a laying belt (10, 11). This is used for compensating fluctuations of the travel speeds of the main carriages (13, 14), e.g., for the profiling of the nonwoven (24) and for avoiding thickened edge areas of the nonwoven (24).

The auxiliary carriages (15, 16) are coupled in a suitable manner each with a main carriage (13, 14), e.g., by a pulling device or by coupled drives. The upper auxiliary carriage (15) is coupled with the upper main carriage (13) and pulls out the belt loop (20) in the counter belt (11). The lower auxiliary carriage (16) is coupled with the lower main carriage (14) and pulls out the belt loop (20) in the infeed belt (10).

The auxiliary carriages (15, 16) are arranged above the discharge belt (23). The one upper auxiliary carriage (15) is arranged with its belt loop (20) above the shielding device (3). The other auxiliary carriage (16) is arranged with its belt loop (20) below the shielding device (3). The auxiliary carriage (16) moves in an intermediate space between said main carriages (13, 14).

A drive device with separate or partially shared drive components are present for the main carriages and the auxiliary carriages (13, 14, 15, 16) and the laying belts (10, 11). These drive components have, e.g., controllable drives, e.g., electric motor servo drives or electric linear motors.

Figure 9:
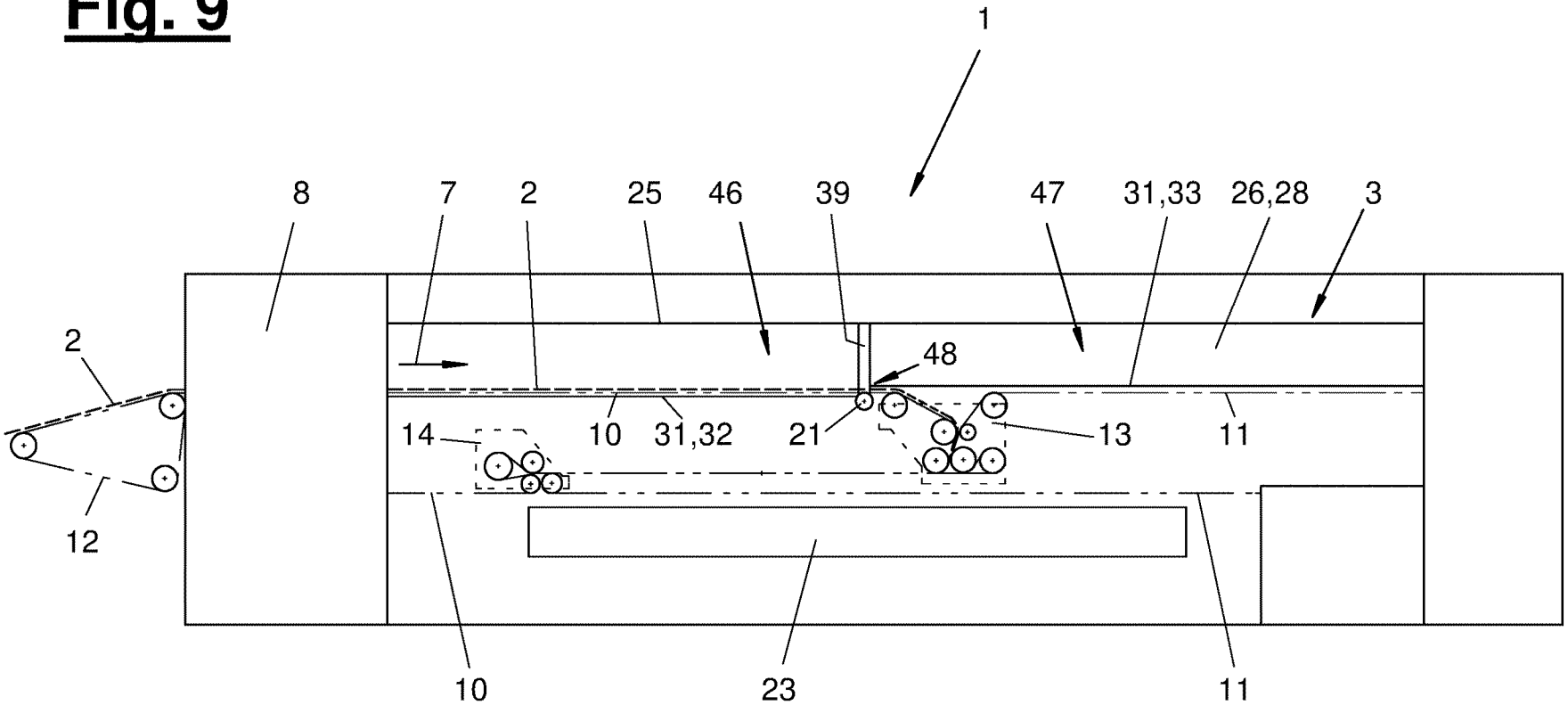
FIG. 9 is a simplified and abstracted view of the arrangement of a housing at a crosslapper.

The crosslapper (1) has the mentioned shielding device (3). This shielding device may be installed during the manufacture of the crosslapper or be used to retrofit an existing crosslapper (1). The shielding device (3) has a protective function for the formed fabric web (2), which is moved and fed on the laying belt (10) to the upper main carriage or upper carriage (13). FIG. 9 shows a simplified and abstracted view of the crosslapper (1) and of the shielding device (3) described below.

The shielding device (3) has a housing, which in the installed position being shown covers the side surfaces (4) of the formed fabric web (2) located on the laying belt (10), which side surfaces extend along the web direction (7), and shields against external environmental effects, especially air flows. In particular, the housing of the shielding device (3) defines an air flow barrier adjacent to the formed fabric web side surfaces (4) located at formed fabric longitudinal edges of the formed fabric web (2). The housing (25) also covers the top side (5) of the formed fabric web (2) in at least some areas and thus all free surfaces of the formed fabric web (2) located on the laying belt (10). The formed fabric web (2) is located with its bottom side (6) on the laying belt (10). The side surfaces (4) are located at the longitudinal edges of the formed fabric web (2).

The housing (25) covers the formed fabric web (2) located on the laying belt (10) on at least one side, especially on the top side (5), preferably on all free sides or surfaces with a distance. The housing (25) shown has, e.g., a hood-like shape and has a wall (26) that is impervious to external environmental effects, especially air flows. In the installed position the housing (25) closely adjoins the laying belt (10), especially the longitudinal edges thereof. Here, the above-mentioned shielding channel is formed by the housing (25) and by the laying belt (10).

The housing (25) extends in the web direction (7) along the laying belt (10) and the formed fabric web (2) lying on it as well as along the travel path of the upper main carriage, especially upper carriage (13). The extension directions may run parallel. They are preferably linear.

The housing (25) extends from the end area (9) on the feed side in the web direction (7) up to the upper main carriage or upper carriage (13) and possibly beyond this. The housing (25) is arranged above said main carriage (13).

The end of the housing (25) on the feed side is located at a disturbance-free area of the crosslapper (1) and outside of the travel paths of the carriages (13, 14, 15, 16). The machine frame (8) has a shape that is, e.g., yoke-like and bridges over the discharge belt (23) with upright columns located at the edges and connecting longitudinal beams as well as with carriage guides (17). The housing (25) may end on the feed side at the inner edge of the column located there and at the edge of the end area (9). It may also extend further into the end area (9) against the web direction (7).

Figure 2:
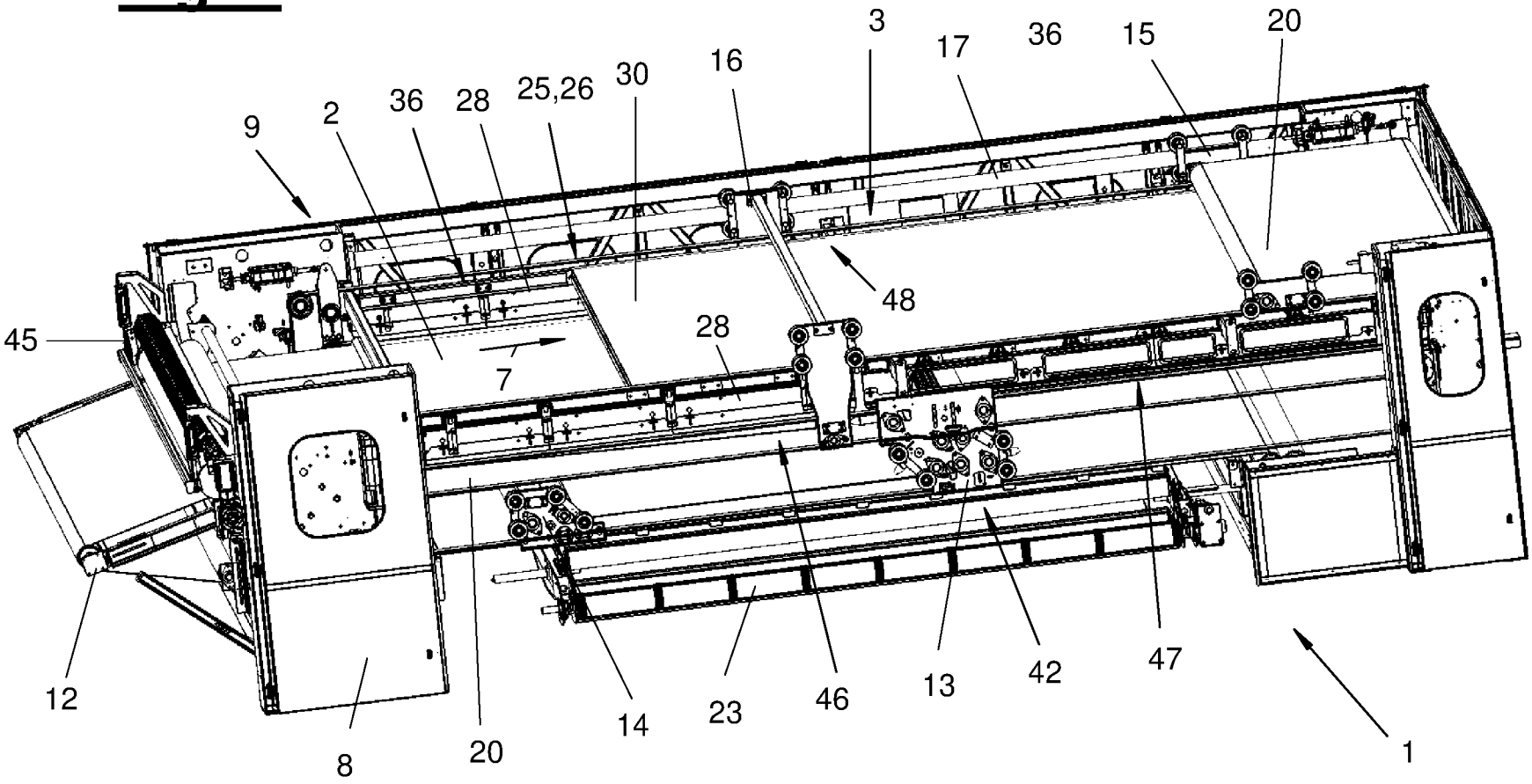
FIG. 2 is another perspective view of the crosslapper from FIG. 1.
Figure 3:
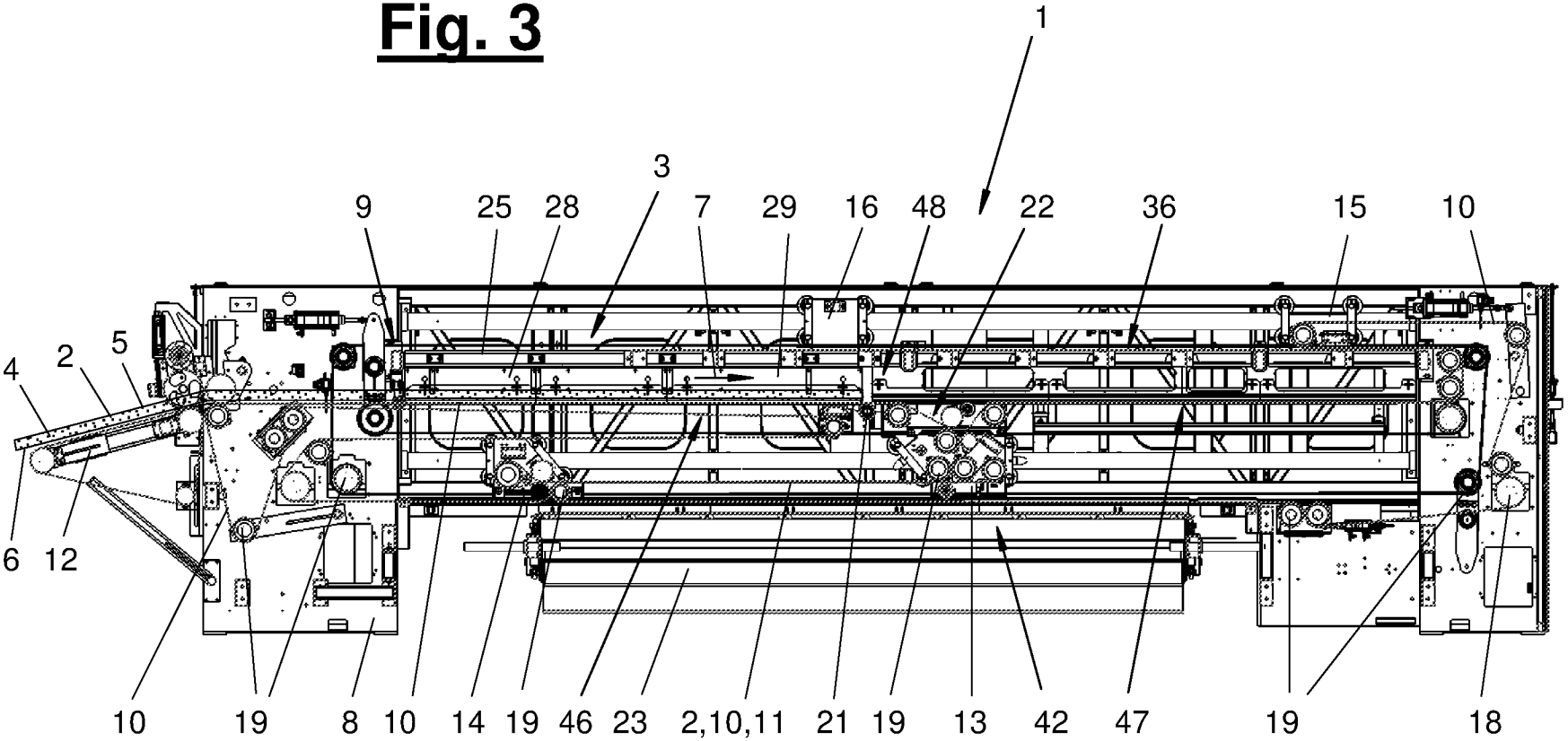
FIG. 3 is a broken-up front view of the crosslapper from FIG. 1 with a shown formed fabric web.

The upper main carriage or upper carriage (13) moves back and forth on its travel path between end positions (41, 42). The one end position (41) is located the farthest from the end area (9) on the feed side. It is shown in FIGS. 1 and 4. The end position (41) is located outside of the distant edge of the discharge belt (23). The other end position (42) is arranged closest to the end area (9) on the feed side. It is shown in FIGS. 2, 3 and 9 and is located approximately in the middle above the discharge belt (23).

The other end of the housing (25) is located, e.g., above the end position (41) which is located the farthest away. The housing (25) extends above the point of entry (22), at which the formed fabric web (2) being fed on the laying belt (10) enters said upper main carriage (13) or upper carriage. As FIG. 4 shows, the housing (25) extends up to the rear edge of said main carriage (13) and possibly a little beyond this. Here, it may also overlap the other laying belt or counter belt (11) fed at the top at the said main carriage (13). The housing (25) may end close to a stationary deflection device (19) for the other laying belt (11).

The housing (25) may have open end faces. The end faces may, as an alternative, be closed up to an inlet area for the formed fabric web (2) and possibly the laying belt (10).

The housing (25) has a, e.g., box-shape configuration. It may have essentially a C-shape in cross section. The wall (26) may have a rounded and/or prismatic shape in cross section. The wall (26) may be configured as solid and impervious. As an alternative, transparent areas, e.g., windows, may be arranged at one or more points. The shielding effect and the air impermeability of the wall (26) are, as a result, not compromised.

The housing (25) and the housing wall (26) are arranged in the crosslapper (1) in the installed position such that they interact on its bottom side with the laying belt (10) and mesh with same in a sealing manner. The housing (25) especially meshes in a sealing manner with the longitudinal edges of the laying belt (10) continuously over its length. The housing (25) may in the process overlap the longitudinal edges of the laying belt (10) transversely to the web direction (7).

The housing (25) meshes differently with the laying belt (10) over its length or in the web direction (7). The housing (25) is divided over its length into partial areas (46, 47). In a first (leading) partial area (46) it extends under the laying belt (10), especially the longitudinal edges thereof. In another, adjoining partial area (47), the housing (25) extends above the laying belt (10) or its longitudinal edges. The first partial area (46) with the extending under extends from the end area (9) on the feed side up to the end position (42) of the upper main carriage (13) or upper carriage, which end position is closest to the end area (9). This leading partial area (46) is located outside of the main carriage travel path.

The other (following) partial area (47), with the extending over, extends from the closest end position (42) up to the remote end position (41) of the upper main carriage (13) or upper carriage and possibly beyond this.

A support device (21), e.g., a freely rotatable support roller, for the laying belt (10) with the formed fabric web (2) located on it, may be present at the transition point (48) between the first partial area and the next or second partial area (46, 47). The change from extending under to extending over of the housing (25) at the laying belt (10) takes place at the transition point (48). The transition point (48) is arranged in the area of an end position (42) on the feed side of the upper main carriage (13) or upper carriage.

The partial area (47) with extending over of the housing (25) is located in the area of the travel path of the upper main carriage (13) or upper carriage. The laying belt (10) is stretched and supported between a deflection device (19) arranged at the end area (9) on the feed side and a deflection device, which is arranged at the point of entry (22) and is displaceable with said main carriage (13). The deflection devices (19) may be configured, e.g., as rotatable deflection rollers or in a different way. The laying belt (10) can be unrolled and rolled up in relation to the housing (25) along said main carriage travel path. The laying belt (10 is unrolled and separated from the extending over of the housing (25) in case of a travel motion directed towards the end area (9) on the feed side and against the web direction (7). In case of the opposite travel motion, the laying belt (10) is rolled up at the housing (25) and brought into contact with the extending over.

Figure 6:
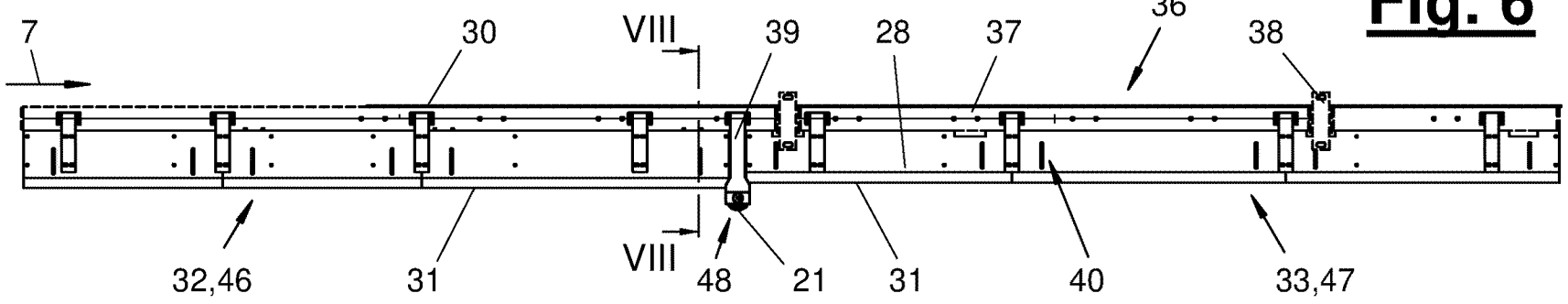
FIG. 6 is a side view according to arrow VI from FIG. 5.

The wall (26) of the housing (25) has side walls (28, 29) extending along the web direction (7), which side walls preferably extend over the entire length of the housing (25). The housing (25) has, furthermore, a top wall (30), which closely adjoins the upper edge of the side walls (28, 29). The top wall (30) may extend over the entire length of the housing (25). It may, as an alternative, have only a partial extension. It may end, e.g., at a distance in front of the end of the housing (25) on the feed side. FIGS. 1, 2 and 6 show this shortened arrangement. The top wall may be absent as well.

Figure 5:
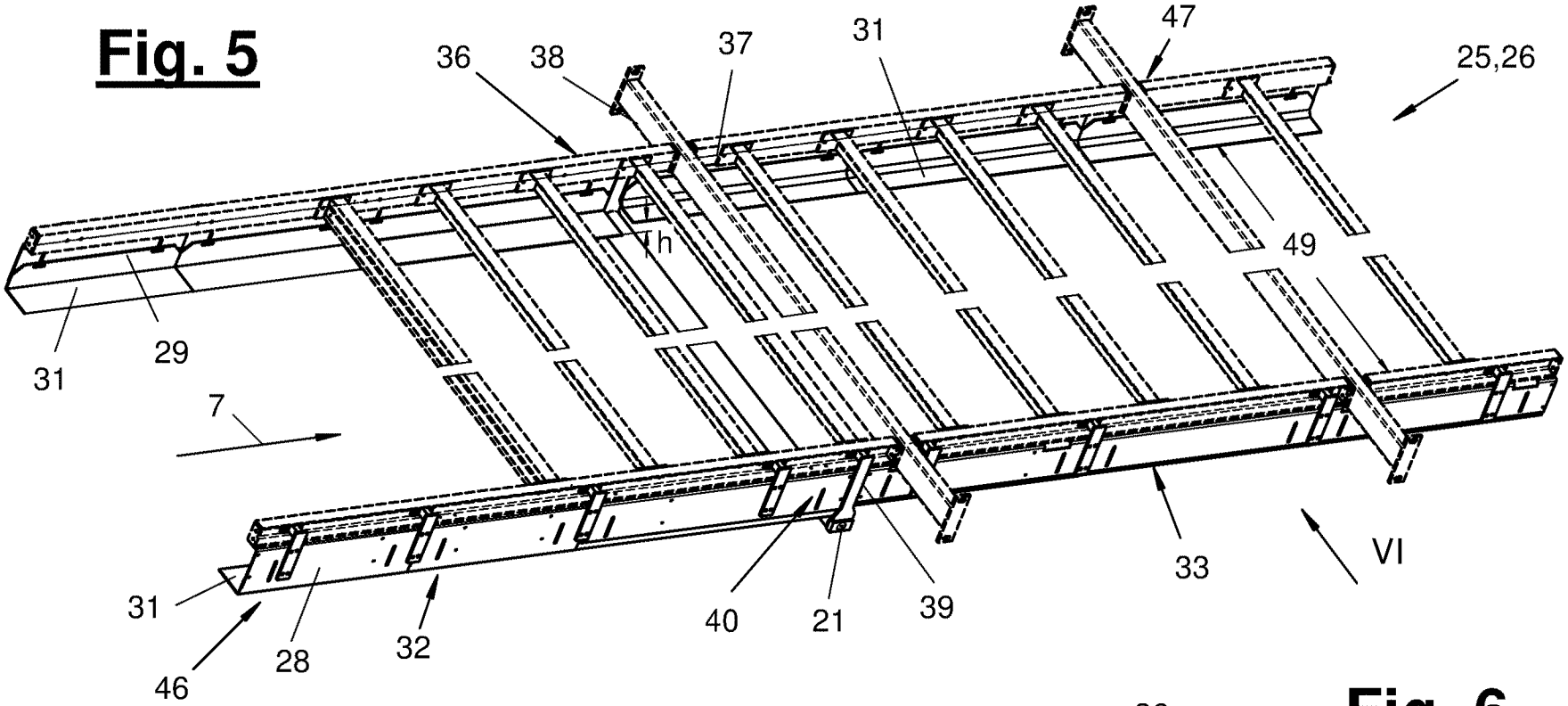
FIG. 5 is a perspective view showing a housing of the shielding device.

The wall (26) has a bottom wall (31) adjoining each of the side walls (28, 29), which bottom wall (31) laterally overlaps the laying belt (10), especially the longitudinal edges thereof. There may be a sealing and possibly largely force-free physical contact or a shorter distance at the overlap points. The side walls, top wall and bottom wall (28, 29, 30, 31)] together form the wall (26). In case of a C-shaped cross section, an open space or slot (49) is present between the bottom walls (31). The slot width may be adapted to the width of the formed fabric web (2). FIGS. 5 and 6 show this embodiment, wherein the top wall (30) is not shown in FIG. 5.

Said extending under or extending over is formed by the bottom walls (31) on both sides. These are divided in the longitudinal direction or web direction (7) into wall sections (32, 33) with different height position and a height difference (h). The division corresponds to the partial areas (46, 47). The transition point between the wall sections (32, 33) may also be arranged at the support device (21).

Figure 7:
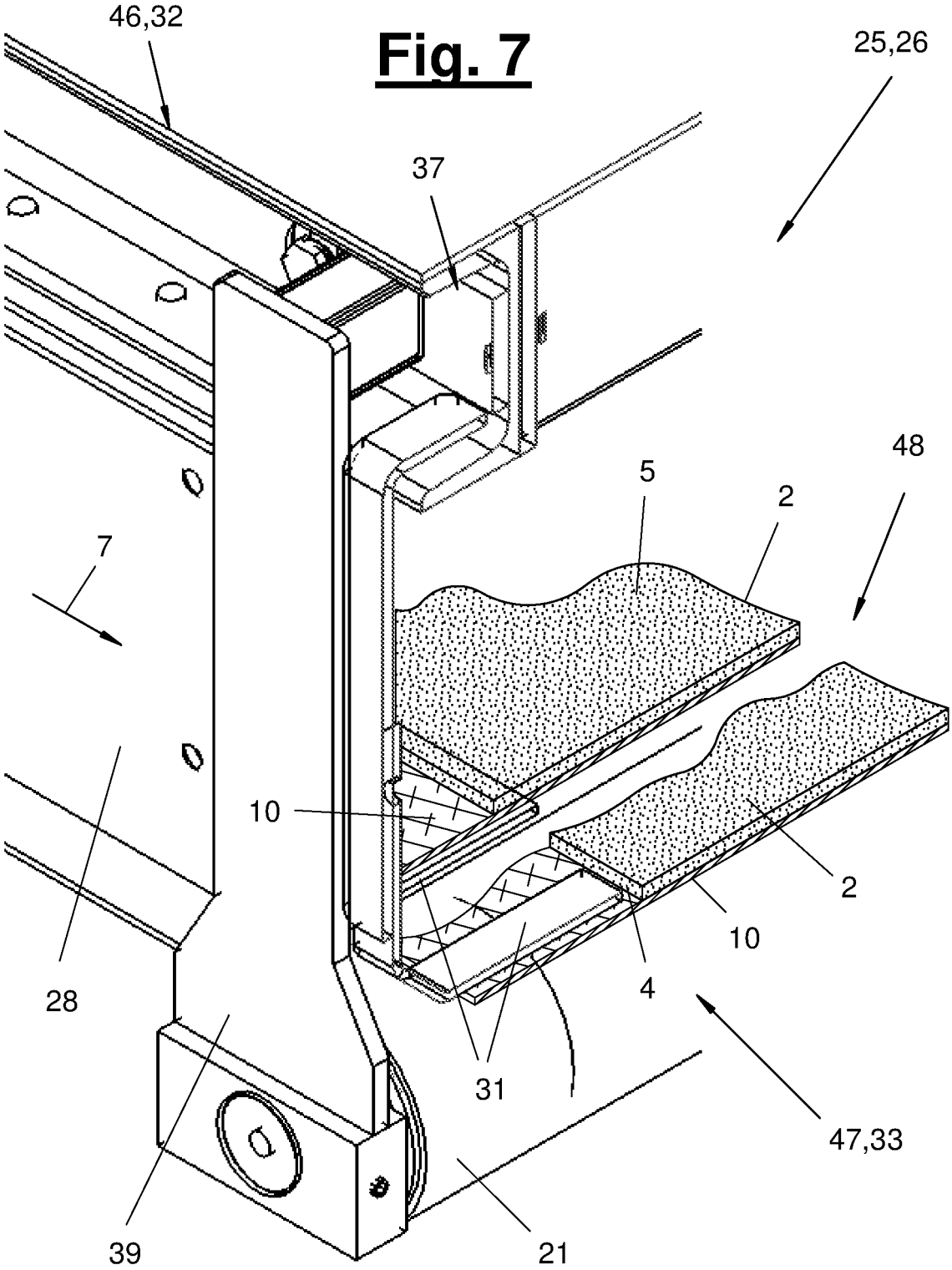
FIG. 7 is a broken-off perspective view of a transition point between extending-under and extending-over wall sections of the housing.
Figure 8:
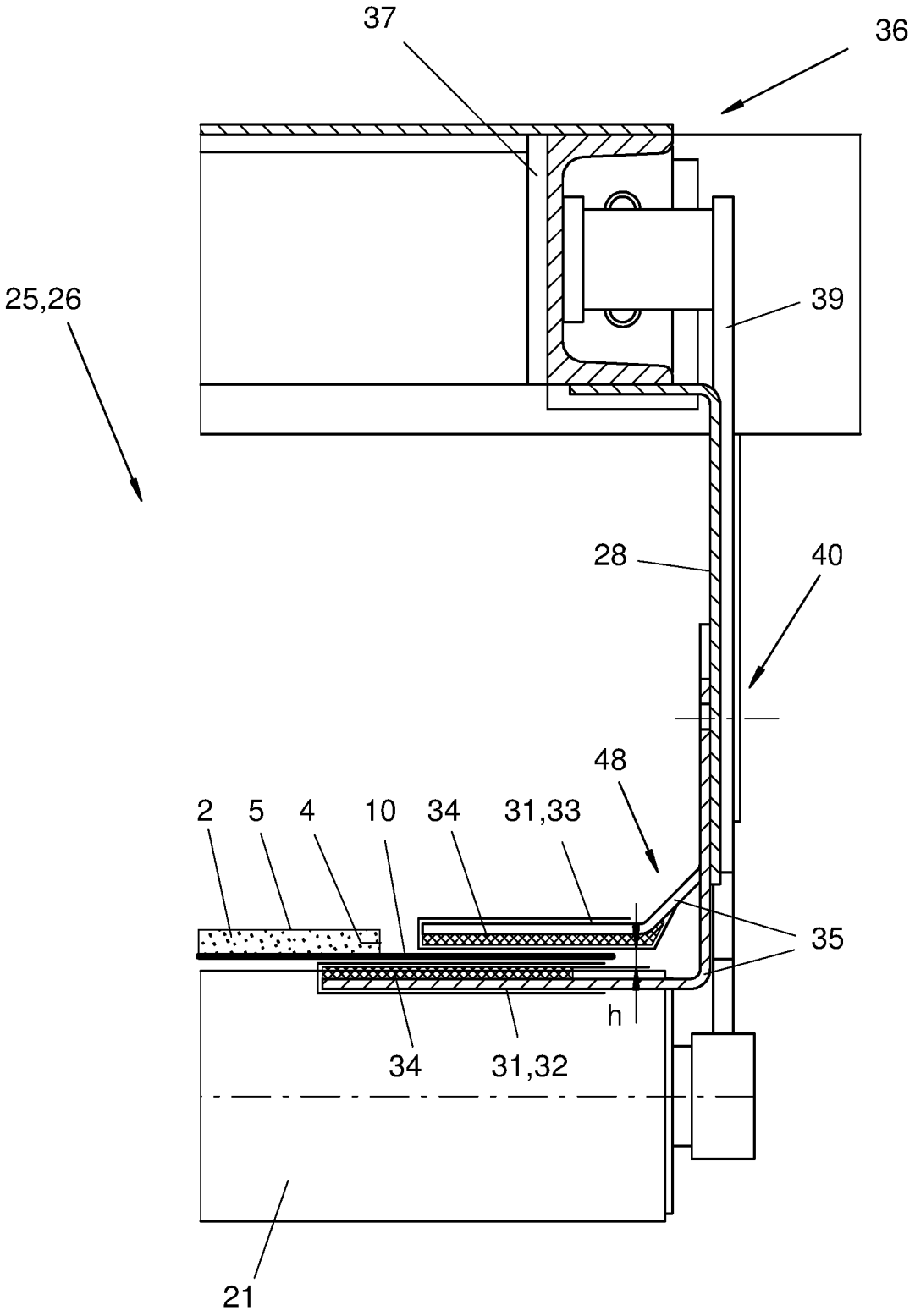
FIG. 8 is a broken-off front view of the arrangement from FIG. 7 according to section line VIII-VIII from FIG. 6.

The wall section (32) of the bottom walls (31) on both sides, which wall section is located in the first (leading) partial area (46), extends under the respective longitudinal edge of the laying belt (10). In the other partial area (47), the bottom walls (31) on both sides of the other wall section (33) extend over the respective longitudinal edge of the laying belt (10). FIGS. 7 and 8 show this arrangement. FIG. 7 shows the transition point between the partial areas (46, 47) and the wall sections (32, 33) in a perspective and partially broken-off view. FIG. 7 also shows the above-mentioned distance of the formed fabric web (2) to the housing (25).

In the wall section (32) with the extending under, the laying belt (10) lies on the respective bottom wall (31) in the overlap area. The side surfaces (4) of the formed fabric web (2) located on the laying belt (10) are spaced apart a little from the respective adjacent side wall (28, 29) and have no physical contact with the housing (25). The distance upwards between the top side (5) and the top wall (30) is greater than the above-mentioned lateral distance. The shielding channel is in this case formed by the side walls (28, 29) and possibly the top wall (30) of the housing (25) as well as the laying belt (10), which lies in a sealing manner at the bottom walls (31).

In the wall section (33) with the extending over, the bottom walls (31) on both sides lie on the laying belt (10) in the overlap area and are likewise spaced apart laterally from the formed fabric web (2). The formed fabric web (2) is arranged on the laying belt (10) in the open space or slot (49) between the bottom walls (31) on both sides. Its side surfaces (4) are covered by the bottom walls (31). The shielding channel is in this case formed by the housing (25) and the laying belt (10), which closely adjoins its bottom side and the bottom walls (31).

FIG. 8 shows this arrangement of the bottom walls (31) in the wall sections (32, 33) in a sectional view. At the area of contact with the laying belt (10) in the extending under and extending over, the bottom walls (31) may each have a sealing coating (34) which promotes sliding. The coating (34) may also be springy. The coating (34) may be, e.g., a foamed plastic.

FIGS. 4 through 7 show the support device (21) and the position thereof. The support device (21) may be arranged and supported at the shielding device (3) and/or at the crosslapper (1). It is located close to the end position (42) closest to the end area (9) and spaced apart against the web direction (7) from the point of entry (22) and the deflection device (19) located there. As a result, at least one part of the housing (25) in the wall area (33) is always in extending-over contact with the laying belt (2).

The partial areas (46, 47) of the housing (25) may have common and continuous side walls (28, 29). They may, as an alternative, have each separate side walls (28, 29) according to FIGS. 5 through 8. These may overlap one another at the transition point or may be spaced apart in the web direction (7) with the formation of a gap, wherein the gap is closed in a suitable manner, e.g., by a part of the support device (21).

The housing (25) has a carrying device (36), which is used for the stationary arrangement of the housing (25) in the crosslapper (1). The carrying device (36) may have a structurally different configuration. FIGS. 4 through 8 show an exemplary embodiment.

The carrying device (36) has a support frame (37) for the wall (26) and support arms (38) to fasten the support frame (37) to the crosslapper (1). According to FIGS. 5 through 8, the support frame (37) has longitudinal beams, which are permanently connected to the support arms (38), which are directed at right angles. At the longitudinal beams, support arms (38), which are directed at right angles to the web direction (7), are arranged for an overlying wall panel. The support arms (38) and the wall panel form the top wall (30). On the other hand, the side walls (28, 29) are mounted in a suspended manner at the longitudinal beams. The bottom walls (31) on both sides are configured, e.g., as angle sections (35). The lower, transversely lying leg of the angle section (35) forms the respective overlap and support for the laying belt (10) in at least some areas. The upright leg of the angle section (35) adjoins the respective side wall (28, 29) and may be fastened here, possibly in a detachable manner.

Upright carrying arms (39), which are likewise mounted in a suspended manner at the longitudinal beams of the support frame (37), may be provided for the support device (21).

The housing (25) and its wall (26) may be adjustable. An adjusting device (40) may be provided for this purpose. With the adjusting device (40), the bottom walls (31) may be mounted at the respective side wall (28, 29) in a height-adjustable manner, e.g., by means of screw connections with elongated holes. The height position and the height difference (h) of the bottom walls (31) at the wall sections (32, 33) may be set differently via the adjusting device (40) for the formation of the extending under and of the extending over.

FIGS. 5 through 8 show the different height positions. The bottom walls (31) and the height difference (h) can be adapted to the respective laying belt (10), especially to the thickness thereof. The setting and adaptation may take place such that the bottom walls (31) at the first wall section (32) adjoin the bottom side of the laying belt (10) and the bottom walls (31) at the next wall section (33) lie on the top side of the laying belt (10).

From a technological point of view, a formed fabric web moved on a laying belt in a crosslapper (1) is fed in the web direction (7) to an upper displaceable main carriage (13), especially to an upper carriage, wherein the side surfaces (4) of the formed fabric web (2) located on the laying belt (10), which side surfaces extend along the web direction (7), are covered and shielded against external environmental effects, and in particular air flows. This takes place by means of a housing (25) of a shielding device (3).

Said formed fabric web (2) is preferably covered on all its free surfaces (4, 5) and shielded against external environmental effects, especially air flows. In one embodiment, the formed fabric web (2) located on the laying belt (10) is covered by the housing (25) without physical contact and with spacing apart. The spacing apart may be present on all sides of the formed fabric web (2).

The housing (25) may have a C-shape in cross section and closely adjoin the laying belt (10) on the bottom side, wherein the formed fabric web (2) is arranged in the slot-like opening (49) of the C-shape and is unrolled or rolled up with the laying belt (10) in case of a travel motion of the upper main carriage (13) in relation to the housing (25).

A variety of variations of the embodiments shown and described are possible. The crosslapper may be configured as a longitudinal layer, especially as a carriage layer, in which the main carriages arranged one above the other move along the discharge direction of the discharge belt. In case of a carriage layer, the laying belts may each individually be associated with a carriage. The wall of the housing (25) may be formed at least partly by a wall of the crosslapper (1). Otherwise, the features of the above-described exemplary embodiments and their variations may be combined and possibly transposed with one another in a different manner.

While specific embodiments of the invention have been shown and described in detail to illustrate the application of the principles of the invention, it will be understood that the invention may be embodied otherwise without departing from such principles.

LIST OF REFERENCE CHARACTERS

1 Crosslapper, crosslayer
2 Formed fabric web
3 Shielding device
4 Side surface
5 Top side
6 Bottom side
7 Web direction
8 Machine frame
9 End area
10 Laying belt, infeed belt
11 Laying belt, counter belt
12 Feed device, feed belt
13 Main carriage, upper carriage
14 Main carriage, laying carriage
15 Auxiliary carriage, tensioning carriage
16 Auxiliary carriage, tensioning carriage
17 Carriage guide
18 Drive device
19 Deflection device, deflection roller
20 Belt loop
21 Support device, support roller
22 Point of entry
23 Discharge belt
24 Nonwoven
25 Housing
26 Wall
27 Interior
28 Side wall
29 Side wall
30 Top wall
31 Bottom wall
32 Wall section
33 Wall section
34 Coating
35 Angle section
36 Carrying device
37 Support frame
38 Support arm
39 Carrying arm for support roller
40 Adjusting device
41 End position, at a distance
42 End position, closest
43 Feed direction
44 Discharge direction
45 Pressing roller
46 Partial area
47 Partial area
48 Transition point
49 Open space, slot
h Height difference

What is claimed is:

1. A crosslapper comprising:

a machine frame with a lateral cladding being present in at least some areas;

a plurality of main carriages including a displaceable upper main carriage;

a discharge belt;

a laying belt guided over the displaceable upper main carriage and driven continuously to feed a formed fabric web on the laying belt in a web traveling direction to the displaceable upper main carriage, wherein the formed fabric web has a bottom side, a top side and side surfaces located at longitudinal edges of the formed fabric web, and the bottom side of the formed fabric web is disposed on the laying belt in a use state of the crosslapper, the main carriages being displaceable over the discharge belt and laying the formed fabric web on the discharge belt with formation of a single-layer or multi-layer nonwoven; and a shielding device comprising a housing arranged in the crosslapper and configured to cover the side surfaces of the formed fabric web which is located on the laying belt and is fed to the displaceable upper main carriage, the side surfaces of the formed fabric web extending along the web traveling direction, and configured to shield the side surfaces of the formed fabric web against external environmental effects by defining an air flow barrier adjacent to the side surfaces of the formed fabric web located at the longitudinal edges of the formed fabric web, wherein the housing is configured to mesh with the laying belt when the laying belt is running in a sealing manner.

2. A crosslapper comprising:

a plurality of main carriages including a displaceable upper main carriage;

a discharge belt;

a laying belt guided over the displaceable upper main carriage and driven continuously to feed a formed fabric web on the laying belt in a web traveling direction to the displaceable upper main carriage, wherein the formed fabric web has a bottom side, a top side and side surfaces located at longitudinal edges of the formed fabric web, and the bottom side of the formed fabric web is disposed on the laying belt in a use state of the crosslapper, the main carriages being displaceable over the discharge belt and laying the formed fabric web on the discharge belt with formation of a single-layer or multi-layer nonwoven; and a shielding device comprising a housing configured to be arranged in the crosslapper and configured to cover the side surfaces of the formed fabric web which is located on the laying belt and is fed to the displaceable upper main carriage, the side surfaces of the formed fabric web extending along the web traveling direction, and configured to shield the side surfaces of the formed fabric web against external environmental effects by defining an air flow barrier adjacent to the side surfaces of the formed fabric web located at the longitudinal edges of the formed fabric web, wherein the housing extends in the crosslapper from an end area of the crosslapper on a side where the formed fabric web is fed up to the displaceable upper main carriage.

3. A crosslapper in accordance with claim 2, wherein the housing extends above a point of entry at the displaceable upper main carriage of the formed fabric web.

4. A crosslapper in accordance with claim 1, wherein:

the housing has a housing longitudinal direction;

the housing is divided into partial areas that are arranged one behind the other in the housing longitudinal direction, the partial areas comprising a leading partial area and a following partial area;

the housing, viewed in the web traveling direction, extends in the leading partial area under longitudinal edges of the laying belt and extends in the following partial area over longitudinal edges of the laying belt, whereby the housing covers the side surfaces of the formed fabric web located on the laying belt.

5. A crosslapper in accordance with claim 4, wherein a transition point is arranged between the partial areas in an area of an end position of a travel path of the displaceable upper main carriage.

6. A crosslapper in accordance with claim 4, wherein:

the leading partial area is arranged with the laying belt extending over a portion of the housing in an area outside of a travel path of the displaceable upper main carriage; and the following partial area is arranged with the laying belt extending under a portion of the housing in an area within the travel path of the displaceable upper main carriage.

7. A crosslapper comprising:

a plurality of main carriages including a displaceable upper main carriage;

a discharge belt;

a laying belt guided over the displaceable upper main carriage and driven continuously to feed a formed fabric web on the laying belt in a web traveling direction to the displaceable upper main carriage, wherein the formed fabric web has a bottom side, a top side and side surfaces located at longitudinal edges of the formed fabric web, the bottom side of the formed fabric web is disposed on the laying belt in a use state of the crosslapper, the main carriages being displaceable over the discharge belt and laying the formed fabric web on the discharge belt with formation of a single-layer or multi-layer nonwoven;

a shielding device comprising a housing arranged in the crosslapper and configured to cover the side surfaces of the formed fabric web which is located on the laying belt and is fed to the displaceable upper main carriage, the side surfaces of the formed fabric web extending along the web traveling direction, and to shield the side surfaces of the formed fabric web against external environmental effects by defining an air flow barrier adjacent to the formed side surfaces of the fabric web located at the longitudinal edges of the formed fabric web; and one or more auxiliary carriages that are displaceable and are coupled with at least one of the plurality of main carriages, the one or more auxiliary carriages being displacebly arranged with a belt loop above the shielding device and/or the one or more auxiliary carriages being displacebly arranged with a belt loop below the shielding device.

8. A crosslapper in accordance with claim 1, wherein the housing is configured to end at an end position of a travel path of the displaceable upper main carriage, wherein the end position of the travel path is located a distance away from a side of the crosslapper where the formed fabric web is fed.

9. A crosslapper in accordance with claim 1, wherein the housing of the shielding device is configured to cover the formed fabric web located on the laying belt at a distance from the formed fabric web disposed on the laying belt at least on one side of the formed fabric web disposed on the laying belt.

10. A crosslapper in accordance with claim 1, wherein the housing comprises:

a first upright and elongated side wall at a first side;

a first bottom wall at the first side adjoining the first upright and elongated side wall, the first bottom wall laterally overlapping the laying belt at a longitudinal edge of the laying belt;

a second upright and elongated side wall at a second side; and a second bottom wall at the second side adjoining the second upright and elongated side wall, the second bottom wall laterally overlapping the laying belt at another longitudinal edge of the laying belt.

11. A crosslapper in accordance with claim 10, wherein the bottom wall at the first side and the bottom wall at the second side have a sealing coating at an area of contact with a respective longitudinal edge of the laying belt.

12. A crosslapper in accordance with claim 10, wherein:

the bottom wall at the first side extends under the laying belt and/or extends above the laying belt in some sections of the housing and the bottom wall at the second side extends under the laying belt and/or extends above the laying belt in some sections of the housing; and the bottom wall at the first side is height adjustable to adapt a height position of the bottom wall at the first side to the laying belt and the bottom wall at the second side is height adjustable to adapt a height position of the bottom wall at the second side to the laying belt.

13. A crosslapper in accordance with claim 10, wherein:

the housing is divided in the web direction into partial areas;

a transition point is arranged between the partial areas and in an area of an end position of a feed side of a travel path of the displaceable upper main carriage; and the first and second side walls of the housing in the partial areas overlap at the transition point and shield the formed fabric web laterally.

14. A crosslapper in accordance with claim 1, wherein the housing has a linear extension with open end faces.

15. A crosslapper in accordance with claim 1, wherein the housing comprises a portion with a C-shape in a cross section and has a bottom with a slot.

16. A crosslapper in accordance with claim 5, further comprising a support device configured to support the laying belt when the laying belt is carrying the formed fabric web at the transition point between the partial areas.

17. A crosslapper in accordance with claim 1, further comprising a carrying device carrying the housing, wherein the carrying device is configured to stationarily arrange the housing in the crosslapper.

18. A crosslapper in accordance with claim 1, wherein the housing is configured to be dimensionally adjustable.

* * * * *